US006893269B2

(12) United States Patent
Matsunaga

(10) Patent No.: US 6,893,269 B2
(45) Date of Patent: May 17, 2005

(54) CONNECTOR EFFICIENTLY FORMING A STANDOFF REGION

(75) Inventor: Akihiro Matsunaga, Tachikawa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/693,450

(22) Filed: Oct. 27, 2003

(65) Prior Publication Data

US 2004/0127072 A1 Jul. 1, 2004

(30) Foreign Application Priority Data

Oct. 28, 2002 (JP) ..... 2002-312467

(51) Int. Cl.[7] ..... H01R 12/00
(52) U.S. Cl. ..... 439/66; 439/81
(58) Field of Search ..... 439/66, 71, 81

(56) References Cited

U.S. PATENT DOCUMENTS 4,533,187 A 8/1985 Kirkman
5,259,777 A * 11/1993 Schuder et al. ..... 439/188
5,466,161 A * 11/1995 Yumibe et al. ..... 439/66
5,746,607 A * 5/1998 Bricaud et al. ..... 439/66
5,879,169 A * 3/1999 Wu ..... 439/74
6,000,969 A * 12/1999 Reichardt et al. ..... 439/630
6,336,815 B1 1/2002 Bestul et al.

FOREIGN PATENT DOCUMENTS

| | | |
|---|---|---|
| JP | 6196226 | 11/1993 |
| JP | 2001176584 | 6/2001 |
| JP | 2002042933 | 12/2001 |
| JP | 2003163045 | 6/2003 |

* cited by examiner

*Primary Examiner*—Ross Gushi
*Assistant Examiner*—X. Chung-Trans
(74) *Attorney, Agent, or Firm*—Baker Botts L.L.P.

(57) ABSTRACT

A connector includes a block-like insulator having a first surface confronting an IC card, and a second surface located on an opposite side relative to the first surface and confronting a wiring board. The insulator has standoff regions in the form of recesses that are formed at boundaries each between the second surface and a surface of the insulator adjacent to the second surface. The standoff regions enable placement of mounting components on the wiring board between the insulator and the wiring board. Contacts are disposed in predetermined positions of the insulator excluding the standoff regions.

7 Claims, 6 Drawing Sheets

CONNECTOR EFFICIENTLY FORMING A STANDOFF REGION

This application claims priority to prior Japanese patent application JP 2002-312467, the disclosure of which is incorporated herein by reference.

BACKGROUND OF THE INVENTION

The present invention relates to a connector for electrically connecting a first connection object such as an IC card to a second connection object such as a printed circuit board.

Connectors disclosed in, for example, JP-A-H06-196226 and JP-A-2000-42933 each include a block-like insulator and conductive contacts retained by the insulator. Each contact has a retention portion fixedly retained by the insulator, a contact portion projected from one surface, i.e. a first surface, of the insulator, and a connecting portion projected from an opposite surface, i.e. a second surface, of the insulator.

The connector of this type can be used for connection between a circuit board and an IC card. Upon use, the connector is set in the state where the second surface of the insulator confronts the circuit board. The connecting portions of the contacts are electrically connected to an electrical circuit of the circuit board. When the IC card is set so as to confront the first surface of the insulator, an electrical circuit embedded in the IC card is electrically connected to the contact portions of the contacts. In this manner, the IC card is connected to the circuit board by the connector.

There are instances where a recessed groove portion is formed at a central portion of the second surface of the insulator. This groove portion can provide a space between the second surface of the insulator and the circuit board where various mounting components such as electronic components can be disposed. The space of this type is called a "standoff region" herein.

Following the reduction in size of devices in recent years, high-density mounting has been required for a connector and mounting components on a circuit board. However, if the connector is simply reduced in size to thereby increase packaging density, the foregoing standoff region is narrowed to disable placement of the mounting components in this region. In this case, the surface of the circuit board can not be used effectively. Further, since it is necessary to ensure springiness of each contact, there is also a limitation on reduction in size of the connector.

SUMMARY OF THE INVENTION

It is therefore an object of the present invention to provide a connector that can achieve a narrow mounting area and further can ensure a sufficiently large standoff region.

Other objects of the present invention will become clear as the description proceeds.

According to an aspect of the present invention, there is provided a connector which comprises a block-like insulator having a first surface and a second surface opposite to the first surface, the first surface confronting a first connection object, the second surface confronting a second connection object; and a plurality of conductive contacts each electrically connecting the first connection object to the second connection object. Each of the conductive contacts comprises a retention portion held by the insulator, a contact portion extending from one end of the retention portion and projecting over the first surface so as to contact the first connection object, and a connecting portion extending from the other end of the retention portion and projecting over the second surface so as to be connected to the second connection object. The insulator has a standoff region which is formed at a boundary between the second surface and a surface adjacent to the second surface and enables a mounting component be placed in the standoff region and mounted on the second connection object. The contacts are disposed in predetermined positions of the insulator excluding the standoff region.

DESCRIPTION OF THE PREFERRED EMBODIMENTS

Referring to FIGS. 1 to 7, description will be given about a connector according to a first preferred embodiment of the present invention.

The shown connector is for connecting a card such as an IC card to a circuit board such as a printed circuit board, and comprises a plurality of conductive contacts 11, and a block-like insulator 21 retaining or holding the contacts 11. The contacts 11 are arrayed in two lines and at regular intervals in a first direction A in each line, and confront each other between the lines in a second direction B perpendicular to the first direction A so as to form pairs, respectively, each formed by the confronting two contacts 11.

Figure 4:
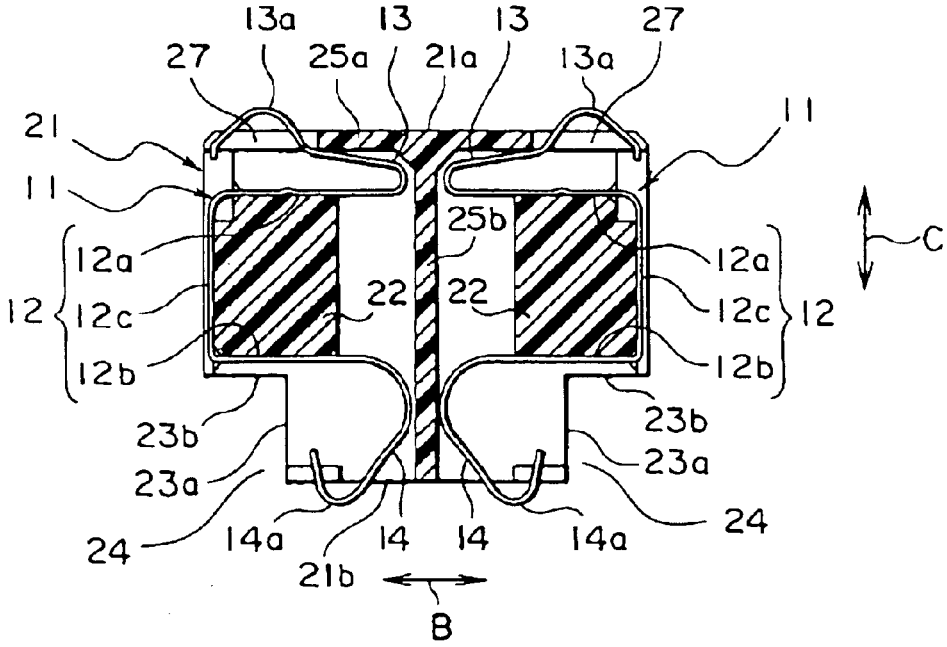
FIG. 4 is a sectional view taken along line IV—IV in FIG. 3.

As best shown in FIG. 4, each contact 11 comprises a retention portion 12 fixedly retained or held by the insulator 21, a first spring portion 13 extending from one end of the retention portion 12, and a second spring portion 14 extending from the other end of the retention portion 12. The retention portion 12 comprises first and second retention portions 12*a* and 12*b* confronting each other in a third direction C perpendicular to the first and second directions A and B so as to be parallel with each other, and a coupling portion 12*c* coupling the first and second retention portions 12*a* and 12*b* to each other. The first spring portion 13 is bent with a small curvature from one end of the first retention portion 12*a* so as to confront the first retention portion 12*a*, and has a substantially half-arc contact portion 13*a* at its free end portion on the tip side thereof. The second spring portion 14 is bent with a large curvature from one end of the second retention portion 12*b* so as to confront the second retention portion 12*b*, and has a substantially half-arc connecting portion 14*a* at its free end portion on the tip side thereof.

From FIG. 4, it is seen that the contact 11 on the left side and the contact 11 on the right side are mounted to the insulator 21 so as to confront each other in the second direction B. The first spring portion 13 extends with a size to confront the whole of the first retention portion 12*a*. The second spring portion 14 extends with a size to confront a portion of the second retention portion 12*b* up to an intermediate point thereof.

Each contact 11 is produced by pressing a thin conductive plate to stamp out a belt-like developed shape of the contact, then applying a bending process thereto. Therefore, when a pressing force is applied to the contact 11 in a direction to cause the contact portion 13*a* and the connecting portion 14*a* to approach each other, the contact portion 13*a* and the connecting portion 14*a* are displaced following elastic deformation of the first and second spring portions 13 and 14, while, when the pressing force is released, the contact 11 is restored to its initial state. Incidentally, the contact 11 may also be produced by bending an elongate contact material in the form of a metal rod.

The contact portion 13*a* is projected from a first surface 21*a* being an upper surface of the insulator 21 to enable an elastic contact with a corresponding one of contact points of a relatively thin card (first connection object) 31 such as an IC card which is set on the first surface 21*a*. The connecting portion 14*a* is projected from a second surface 21*b* being a bottom surface of the insulator 21, which is a surface opposite to the first surface 21*a* of the insulator 21, to be thereby connected to a corresponding one of conductive pads of a printed circuit board or wiring board (second connection object) 41.

Figure 5:
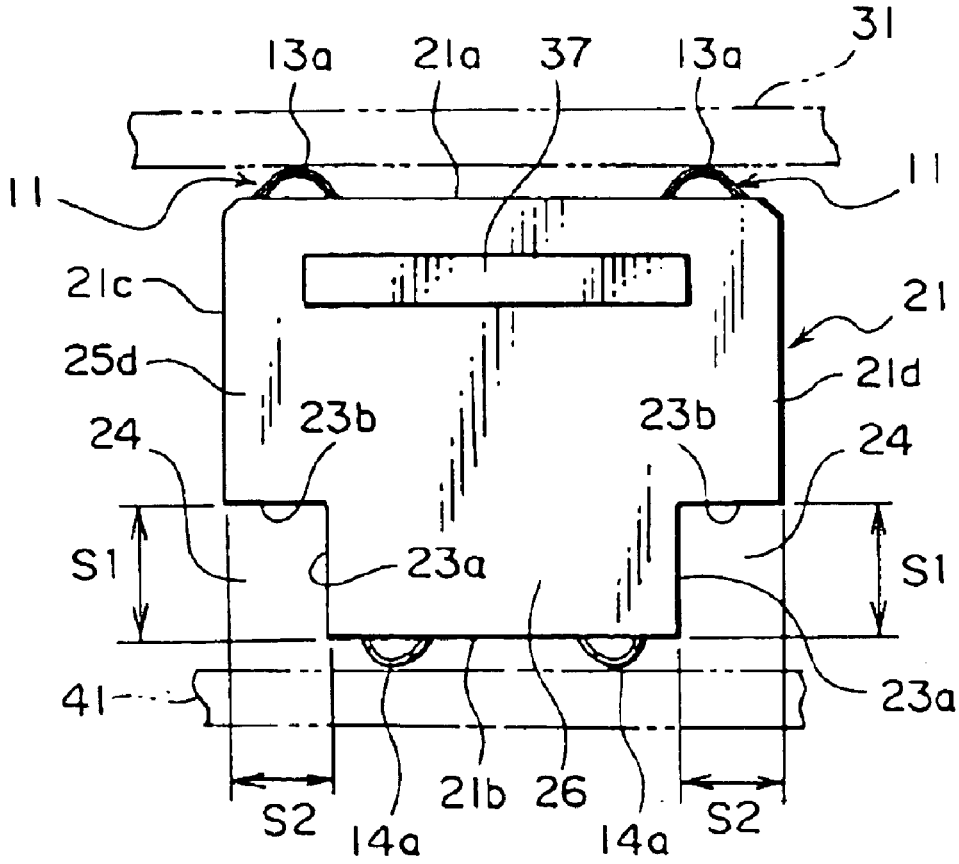
FIG. 5 is a front view of the connector of FIG. 1.
Figure 6:
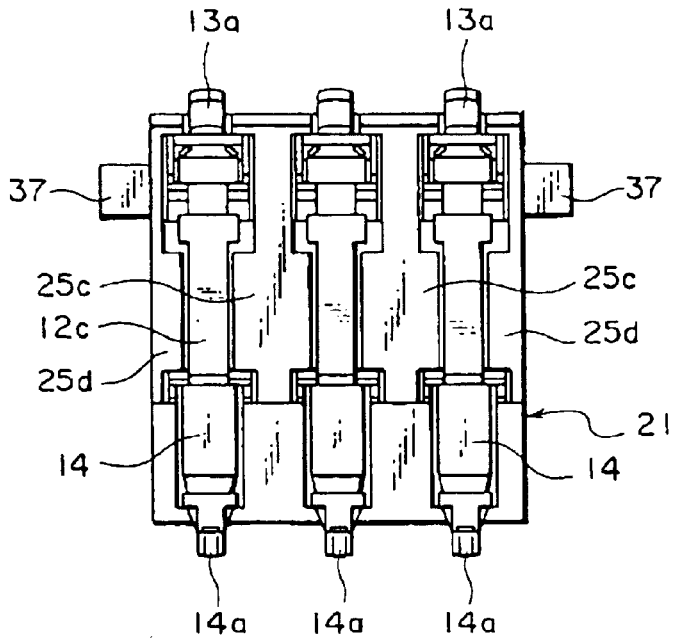
FIG. 6 is an enlarged right side view of the connector of FIG. 1.
Figure 7:
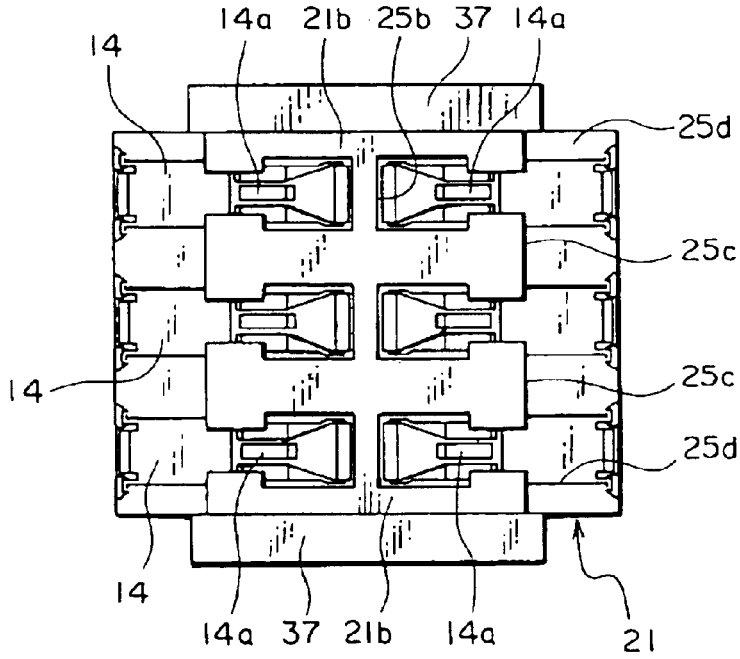
FIG. 7 is an enlarged bottom view of the connector of FIG. 1.

As well seen from FIG. 5, at a lower part of the insulator 21 are provided two standoff regions 24 in the form of large spaces that are formed by cutouts at right and left ends of the insulator 21 seen from the front, respectively. Each standoff region 24 is efficiently defined by mutually perpendicular two wall surfaces 23*a* and 23*b* such that it has a size S1 in the third direction C and a size S2 in the second direction B, and extends over the whole width of the insulator 21 in the first direction A. Accordingly, mounting components such as electronic components can be placed in each standoff region 24 on the wiring board 41. A portion of the insulator 21 between the standoff regions 24 serves as a mounting portion 26 that confronts the wiring board 41 in an approaching state or a contacting state.

The first spring portion 13, the retention portion 12, and the second spring portion 14 of each contact 11 are disposed in predetermined positions of the insulator 21 excluding the standoff regions 24. As well shown in FIG. 4, the insulator 21 has a substantially T-shaped portion in cross section which comprises an upper plate portion 25*a* in the form of a flat plate, and a central plate portion 25*b* extending downward in the third direction C from the middle of the upper plate portion 25*a*.

The insulator 21 further comprises a plurality of retaining plate portions 25*c* confronting the central plate portion 25*b* to serve as partitions between the contacts 11 in the first direction A, and outer plate portions 25*d* on the outermost side. The retaining plate portions 25*c* and the outer plate portions 25*d* are joined to the upper plate portion 25*a* and the central plate portion 25*b*.

The upper plate portion 25*a* is formed with a plurality of cutout portions 27 extending in the second direction B toward the central plate portion 25*b* from a pair of mutually confronting edges on both sides of the upper plate portion 25*a*. The cutout portions 27 are located at regular intervals in the first direction A. The contact portions 13*a* of the contacts 11 are inserted through the cutout portions 27 in one-to-one correspondence. In this manner, the first spring portion 13 of each contact 11 is biased in advance by the upper plate portion 25*a*.

An upper surface of the upper plate portion 25*a* is the flat first surface 21*a* confronting a flat surface of the card 31 provided with the contact points. Lower surfaces of the outer plate portions 25*d* and the retaining plate portions 25*c* are the flat second surface 21*b* confronting the wiring board 41. Both end surfaces of the insulator 21 in the second direction B are referred to as a third surface 21*c* and a fourth surface 21*d*, respectively. The foregoing standoff regions 24 are formed at the boundary between the second surface 21*b* and the third surface 21*c* and at the boundary between the second surface 21*b* and the fourth surface 21*d*, respectively.

The connector is set so that the first and second surfaces 21*a* and 21*b* confront the card 31 and the wiring board 41 in the third direction C, respectively. Arc portions of the contact portions 13*a* of the contacts 11 are projected over the first surface 21*a* through the cutout portions 27, while arc portions of the connecting portions 14*a* are projected over the second surface 21*b*. The connecting portions 14*a* are disposed so as not to enter the standoff regions 24.

Further, the retention portions 12 of the contacts 11 are disposed between the mutually adjacent retaining plate portions 25*c* of the insulator 21 and between the retaining plate portions 25*c* and the outer plate portions 25*d*, respectively. Specifically, the retention portion 12 of each contact 11 is mounted so as to be fitted into a mounting wall portion 22 of the insulator 21 from the outside.

The contacts 11 are disposed symmetrically in the second direction B with respect to the central plate portion 25*b*. Further, in the insulator 21, the upper plate portion 25*a*, the retaining plate portions 25*c*, and the cutout portions 27 are located symmetrically in the second direction B with respect to the central plate portion 25*b*, respectively. The first spring portions 13 each excluding the contact portion 13*a*, the retention portions 12, and the second spring portions 14 each excluding the connecting portion 14*a* of the contacts 11 are disposed in a space portion surrounded by the upper plate portion 25*a*, the retaining plate portions 25*c*, and the outer plate portions 25*d*.

Figure 1:
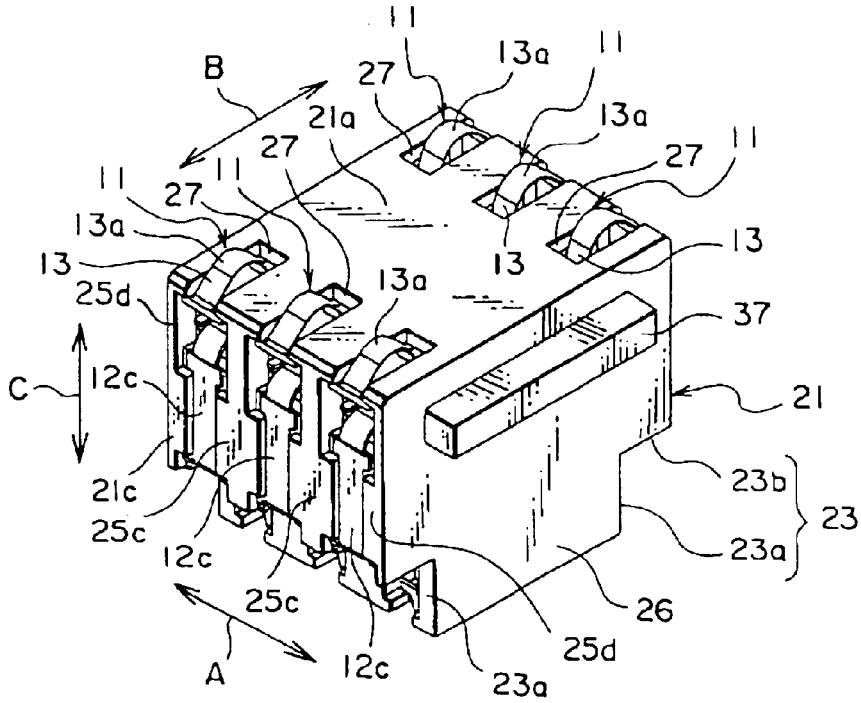
FIG. 1 is a perspective view of a connector according to a first preferred embodiment of the present invention.
Figure 2:
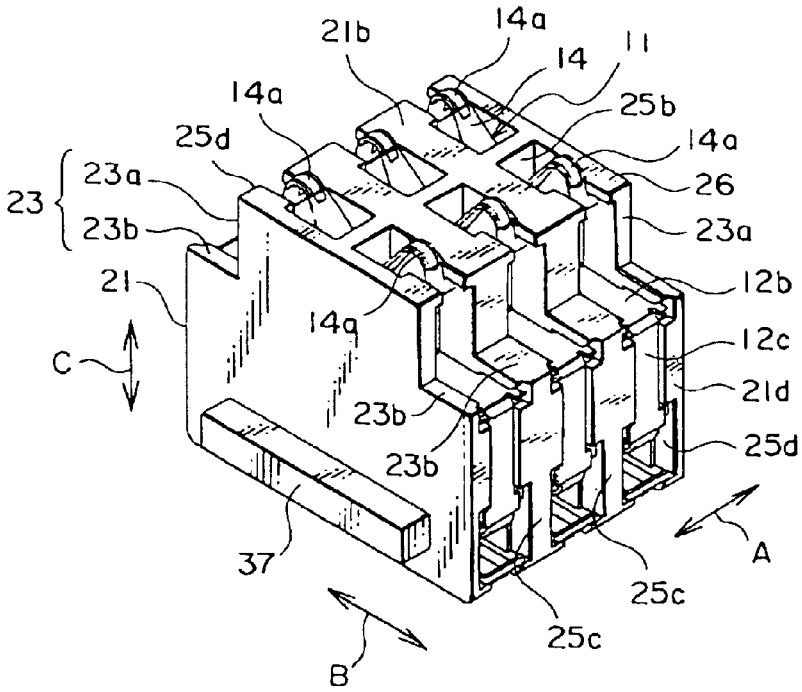
FIG. 2 is a perspective view of the connector of FIG. 1, seen from another direction.
Figure 3:
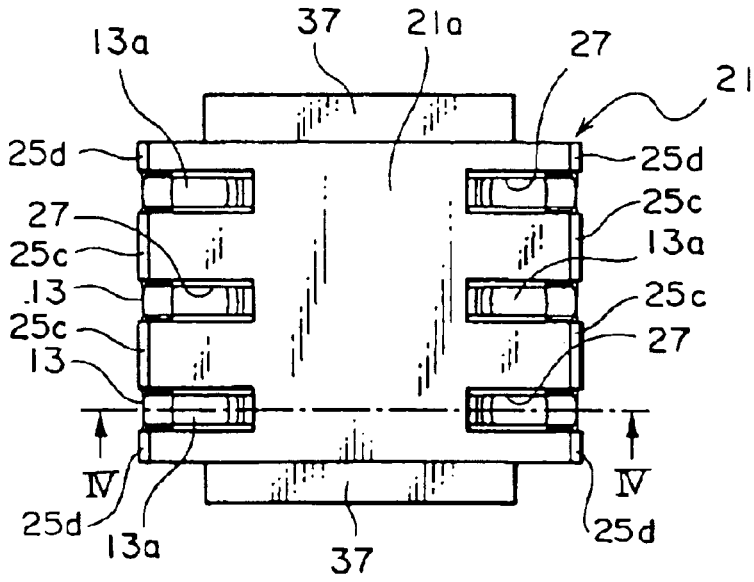
FIG. 3 is a plan view of the connector of FIG. 1.

The retention portions 12 of the contacts 11 are inserted into the space portion inside the insulator 21 from both sides of the insulator 21 in the second direction B so that the contacts 11 are retained by the retaining plate portions 25*c*. In this event, the contact portions 13*a* are projected from the first surface 21*a* through the cutout portions 27 of the upper plate portion 25*a*, while the connecting portions 14*a* are projected from the second surface 21*b* of the insulator 21. Here, the connector is mounted on the wiring board 41 in a posture as shown in FIGS. 1, 4, and 5. The wiring board 41 is provided with a plurality of conductive pads (not shown), and the connecting portions 14*a* of the contacts 11 are brought into pressure contact with the conductive pads in one-to-one correspondence. Then, a plurality of contact points (not shown) of the card 31 are brought into pressure contact with the contact portions 13*a* in one-to-one correspondence. In this event, a pair of flange portions 37 each in the form of a convex strip elongate in the second direction B, which are provided on outer surfaces of the pair of outer plate portions 25*d*, are pushed in the third direction C toward the wiring board 41, thereby to achieve the pressure contact between the connecting portions 14*a* of the contacts 11 and the conductive pads of the wiring board 41. In this manner, the contacts 11 electrically connect the card 31 and the wiring board 41 to each other while keeping elastic forces thereof in the third direction C. The flange portions 37 are supported by a non-shown housing or the like to thereby maintain the foregoing pressure contact. Accordingly, when the connector is mounted on the wiring board 41, the second spring portions 14 of the contacts 11 are also put in the state of being biased in advance.

Figure 8:
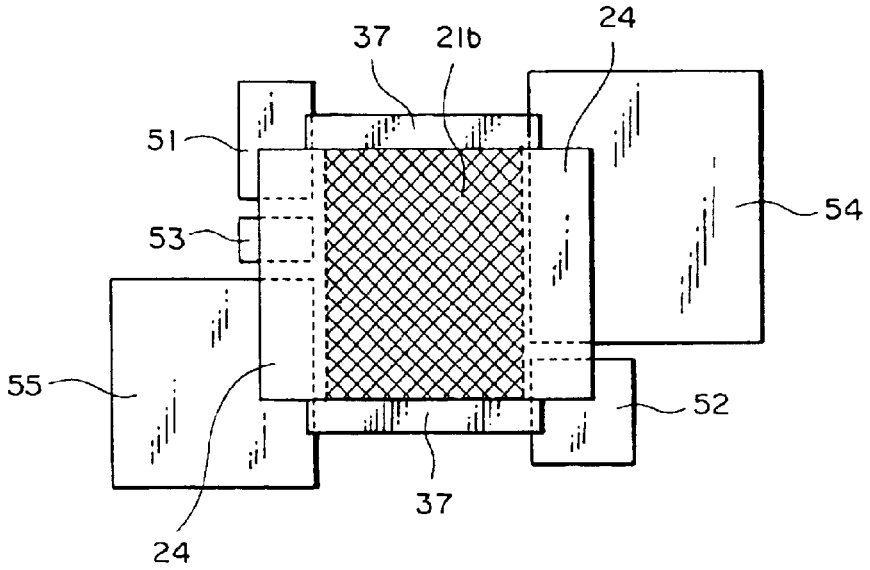
FIG. 8 is a layout diagram for explaining a layout relationship between the connector of FIG. 1 and mounting components.

Referring to FIG. 8, a layout relationship between the connector shown in FIG. 1 and mounting components being various electronic components will be described.

In FIG. 8, a meshed portion corresponds to the second surface 21*b* of the insulator 21, and both sides of the second surface 21*b* represent the standoff regions 24. On the wiring board 41, the connector can be placed in the state where portions of middle-sized mounting components 51 and 52, a small-sized mounting component 53, and large-sized mounting components 54 and 55 enter the standoff regions 24.

In the standoff regions 24, mounting positions of the middle-sized mounting components 51 and 52, the small-sized mounting component 53, and the large-sized mounting components 54 and 55 are determined in advance. This makes it possible to mount the components within the standoff regions 24 in case of only the small-sized components 53, while, when the middle-sized mounting components 51 and 52 or the large-sized mounting components 54 and 55 are included, to mount portions thereof within the standoff regions 24. Therefore, it is possible to arrange the mounting components at high density along with the connector on the wiring board 41.

Figure 9:
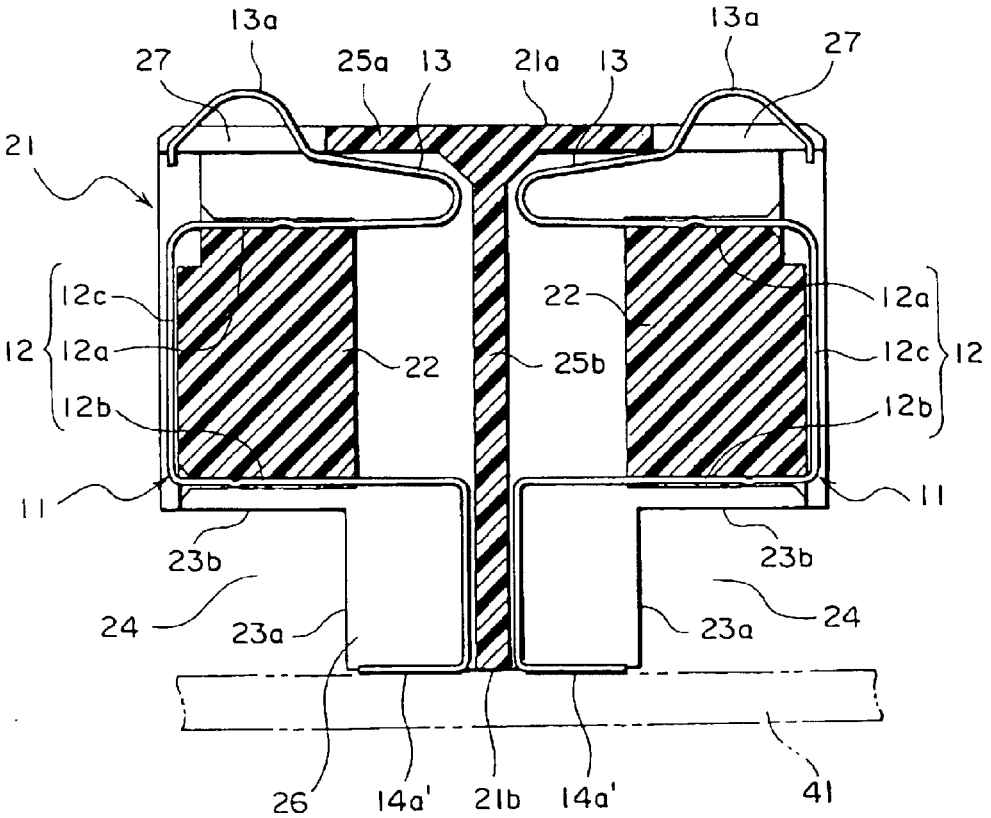
FIG. 9 is a sectional front view of a connector according to a second preferred embodiment of the present invention.

Referring to FIG. 9, description will be given about a connector according to a second preferred embodiment of the present invention. Those portions having the same functions as the connector of FIGS. 1 to 7 are assigned the same reference symbols to thereby omit description thereof.

Contacts 11 each extend in a straight line along a central plate portion 25*b*, and connecting portions 14*a*' are bent symmetrically and perpendicularly in opposite directions to part from each other. Specifically, each contact 11 extends along a mounting portion 26 and is bent so as to be parallel with the surface of a wiring board 41 like the wiring board 41 shown in FIG. 5, and is connected to a corresponding one of conductive pads of the wiring board 41 by soldering.

Figure 10:
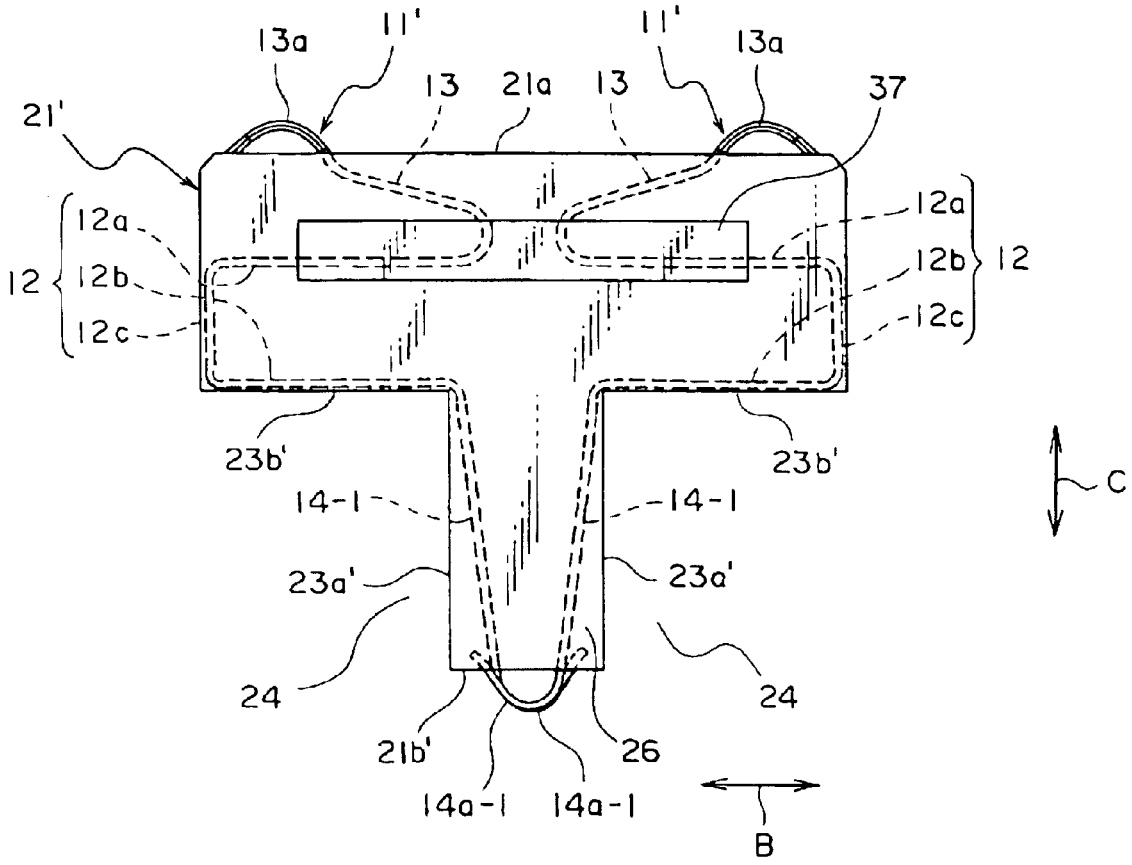
FIG. 10 is a front view of a connector according to a third preferred embodiment of the present invention.

Referring to FIG. 10, description will be given about a connector according to a third preferred embodiment of the present invention. Those portions and components achieving the same functions as the connector of FIGS. 1 to 7 are assigned the same reference symbols so that description thereof may be omitted.

In the connector shown in FIG. 10, cutouts each defined by wall surfaces 23*a*' and 23*b*' are provided on both sides of a second surface 21*b*' to thereby provide standoff regions 24 between a wiring board like the wiring board 41 shown in FIG. 5 and an insulator 21'. In the connector of FIGS. 1 to 7, the contacts 11 are retained in two lines so as to confront each other in the second direction B. On the other hand, in the connector of FIG. 10, contacts 11' do not confront each other in the second direction B. The contacts 11' are arranged in the first direction in two lines and shifted in position so as not to confront each other in the second direction B. Second spring portions 14-1 or connecting portions 14*a*-1 are arranged in one line at regular intervals in the first direction A at the middle of the insulator 21'.

In the contacts 11', by employing the structure where the second spring portions 14-1 are arranged in one line so as to confront each other in the first direction A, each of the standoff regions 24 of the insulator 21' is larger in size than that of the insulator 21 of the connector shown in FIG. 1. Therefore, it is possible to set mounting components along with the connector on the wiring board in the state where many small-sized mounting components or portions of many middle-sized and large-sized mounting components enter the standoff regions 24.

What is claimed is:

1. A connector comprising:

a block-like insulator having a first surface and a second surface opposite to said first surface, said first surface confronting a first connection object, said second surface confronting a second connection object; and a plurality of conductive contacts each electrically connecting said first connection object to said second connection object, each of said conductive contacts comprising:

a retention portion held by said insulator;

a contact portion extending from one end of said retention portion and projecting over said first surface so as to contact said first connection object; and a connecting portion extending from the other end of said retention portion and projecting over said second surface so as to be connected to said second connection object, said insulator having a standoff region which is formed at a boundary between said second surface and a surface adjacent to said second surface and enables a mounting component be placed in said standoff region and mounted on said second connection object, said contacts being disposed in predetermined positions of said insulator excluding said standoff region; wherein said standoff region comprises two regions, said insulator having a mounting portion between said two regions, said mounting portion approaching to confront said second connection object.

2. The connector according to claim 1, wherein said insulator has a plate portion dividing said mounting portion into two parts corresponding to said two regions, said connecting portions of the contacts being disposed on both sides of said plate portion, respectively.

3. The connector according to claim 1, wherein each of said contacts has a spring portion for giving springiness to said contact portion, said insulator having a plate portion biasing said spring portion in advance.

4. The connector according to claim 1, wherein said insulator has a mounting wall portion, said retention portion of each contact being fitted into said mounting wall portion from the outside.

5. The connector according to claim 1, wherein each of said contacts has a spring portion for giving springiness to said connecting portion.

6. The connector according to claim 1, wherein said insulator has a mounting portion approaching to confront said second connection object, each of said contacts extending along said mounting portion to have said connecting portion at an end portion thereof.

7. A connector according to claim 1, wherein said connecting portions of the contacts are arrayed in one line at an interval therebetween.

* * * * *